United States Patent [19]

Branconi

[11] 4,077,140

[45] Mar. 7, 1978

[54] HYDRAULIC EXCAVATOR EQUIPMENT FOR EXCAVATION LATERALLY OF THE EXCAVATOR

[75] Inventor: Marcello Branconi, Turin, Italy

[73] Assignee: Societa Italiana Macchine Industriali Torino, S.p.A., Grugliasco (Turin), Italy

[21] Appl. No.: 780,527

[22] Filed: Mar. 23, 1977

[30] Foreign Application Priority Data

Mar. 31, 1976 Italy ..... 67751 A/76

[51] Int. Cl.[2] ..... E02F 5/02

[52] U.S. Cl. ..... 37/103; 214/131 R; 214/138 D

[58] Field of Search ..... 37/103, 117.5; 214/131 R, 132, 133, 138 D, 145 R, 146

[56] References Cited

U.S. PATENT DOCUMENTS

| | | | |
|---|---|---|---|
| 2,846,094 | 8/1958 | Pilch | 37/103 |
| 3,027,026 | 3/1962 | Couquet | 37/103 |
| 3,072,272 | 1/1963 | Howlett | 37/103 X |
| 3,339,763 | 9/1967 | Caywood et al. | 214/132 X |
| 3,977,547 | 8/1976 | Holopainen | 214/131 R |
| 3,978,998 | 9/1976 | Klitz | 214/132 |
| 4,007,845 | 2/1977 | Worback | 214/138 D |

FOREIGN PATENT DOCUMENTS

| | | | |
|---|---|---|---|
| 763,754 | 7/1967 | Canada | 214/138 D |
| 696,187 | 10/1965 | Italy | 37/103 |
| 6,609,794 | 1/1968 | Netherlands | 37/103 |
| 823,464 | 11/1959 | United Kingdom | 37/103 |
| 171,806 | 11/1965 | U.S.S.R. | 37/103 |

*Primary Examiner*—E. H. Eickholt
*Attorney, Agent, or Firm*—August E. Roehrig, Jr.; Robert A. Brown; Harvey W. Rockwell

[57] ABSTRACT

A hydraulic excavator for excavating laterally of the excavator's position on a work plane which includes a two part or compound lever lifting arm wherein the first part or portion of the lifting arm is pivoted at one end to an excavator base by a support pin to permit the lift arm to move vertically in a plane extending normal to the excavator base or work plane. A second part or portion of the lift arm is pivotally connected to the end of the first portion opposite to the excavator base to rotate relative to the first portion in the same vertical plane of movement. A side positioning arm is pivotably connected to the second portion of the lifting arm for movement in a horizontal plane parallel to the work plane or excavator base. A working arm, having an excavating apparatus such as a bucket, is pivotably connected to the free end of the side positioning arm for movement in a vertical plane extending normal to the plane of movement of the side positioning arm. Hydraulic actuators are provided for controlling the rotation of the arms and movement of the excavating apparatus.

9 Claims, 3 Drawing Figures

HYDRAULIC EXCAVATOR EQUIPMENT FOR EXCAVATION LATERALLY OF THE EXCAVATOR

BACKGROUND OF THE INVENTION

In the use of hydraulic excavator equipment, unless the center line of the excavation lies in a vertical plane passing through the longitudinal axis of the excavator, the side or lateral walls of the excavation are not maintained normal or perpendicular to the work plane upon which the excavator is operating. However, in many instances it is desirable or necessary to excavate from a position wherein the excavating or digging arm is operating in a position offset laterally from the longitudinal axis of the excavator. In order to maintain the side walls of the excavation perpendicular or normal to the ground surface work plane it has been necessary to tilt the excavator or the excavating arm about the longitudinal axis of the excavator.

Such tilting is necessary because as the lifting arm, to which a digging bucket is operatively connected, is raised or lowered in digging operations, the relative position between the bucket and the longitudinal axis of the excavator base is changed. The movement of the lifting arm, when excavating laterally of the excavator base, causes the plane of bucket movement to be rotated about the longitudinal axis of the excavator resulting in a "tilted" trench, both as to the excavation side walls and bottom.

As a consequence of the moving of the lifting arm, this rotation of the path of bucket movement with respect to the longitudinal axis of the excavator base effects a different tilt to the side walls of the excavation. The side walls so formed do not lie in parallel planes normal to the excavator base and work plane, with the degree of tilt being proportionately greater as the depth of the excavation increases. Such asymmetry in the excavation side walls requires further finishing work to eliminate this tilt of the side walls as well as the slope of the excavation bottom.

SUMMARY OF THE INVENTION

It is, therefore, an object of the present invention to improve hydraulic excavator equipment for effecting excavation laterally of the excavator.

Another object of this invention is to effect excavations laterally of the excavator which have side walls lying in parallel planes extending normal to the plane of the excavator base and parallel to the longitudinal axis of the excavator.

A further object of this invention is to maintain the plane of movement of an excavating bucket normal to the work plane throughout the depth of the excavation.

These and other objects are attained in accordance with the present invention, wherein there is provided an excavator having a compound lifting arm pivotably connected to a base for movement in planes normal thereto, and operatively connected to a digging bucket such that movement of the lifting arm during excavation automatically adjusts the pivot centers of the linkages connected to the digging bucket to maintain the bucket movement in a plane normal to the excavator base and work plane.

DESCRIPTION OF THE DRAWINGS

Further objects of the invention together with additional features contributing thereto and advantages accruing therefrom will be apparent from the following description of a preferred embodiment of the invention which is shown in the accompanying drawings, wherein like reference numerals indicate corresponding parts throughout wherein.

DESCRIPTION OF A PREFERRED EMBODIMENT

Figure 1:
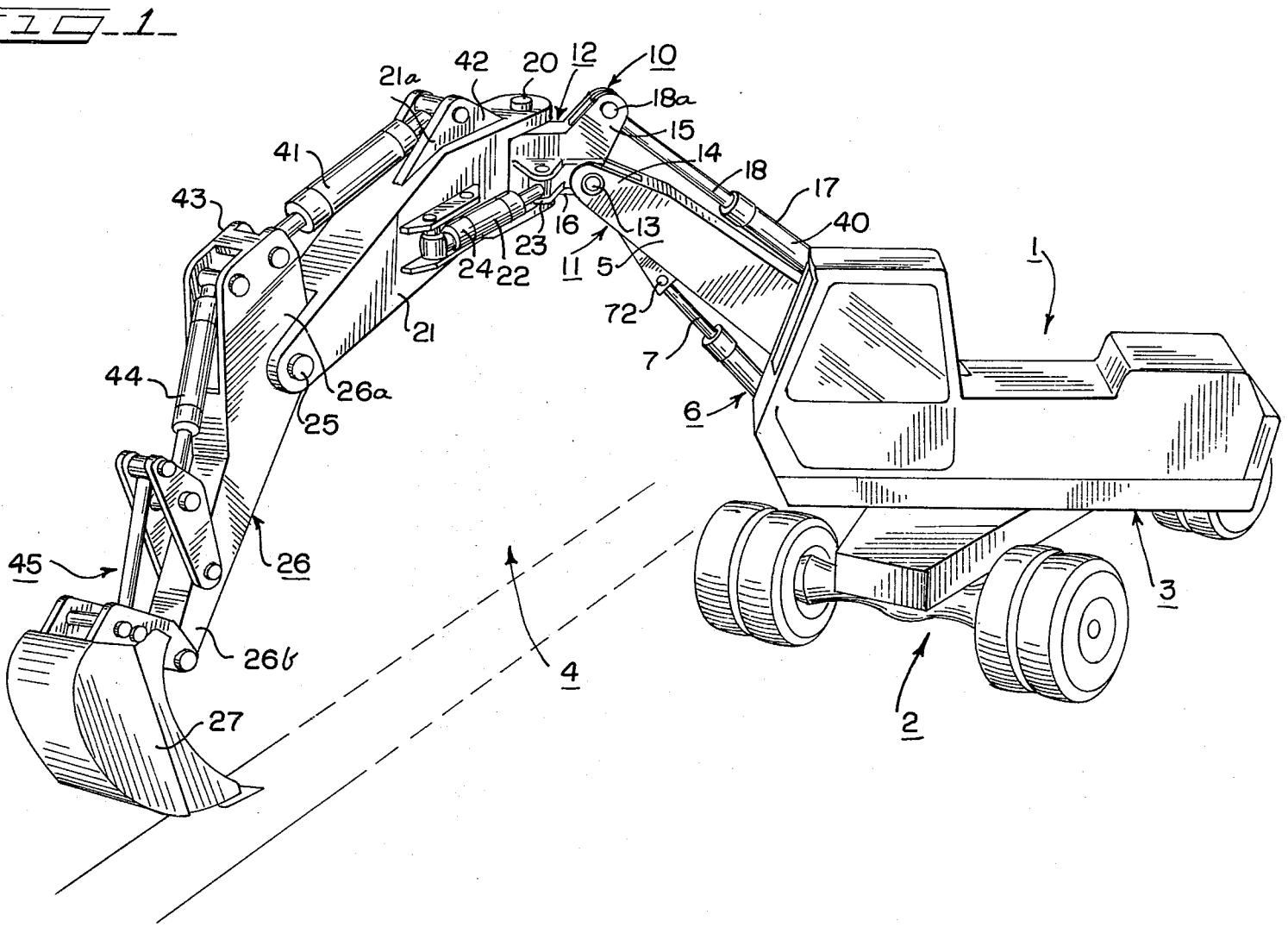
FIG. 1 is a perspective view of a hydraulic excavator provided with equipment according to the invention.

Referring now to FIG. 1 there is shown a self-propelled hydraulic excavator 1 carried on a support frame or base 2 to enable the excavator to be moved over ground or a work plane. A control cabin which houses the excavator operator and lifting equipment 4 are carried upon a revolving platform 3 supported on the excavator frame or base 2. The digging or excavating equipment 4 enables the hydraulic excavator to perform excavations in the work plane parallel to and displaced laterally from the longitudinal axis of the excavator support frame 2.

Figure 2:
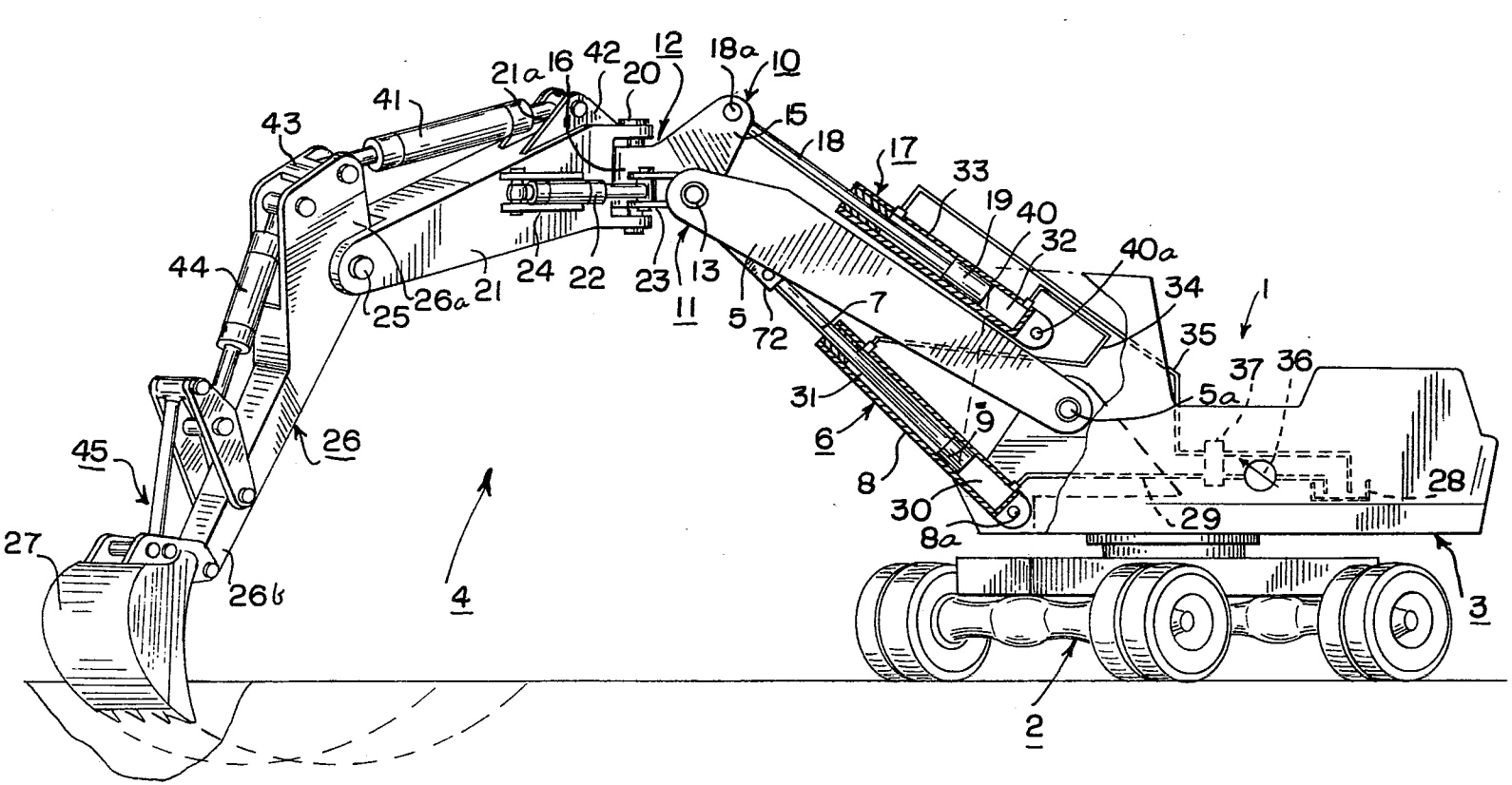
FIG. 2 is a partially diagrammatic side view of the apparatus shown in FIG. 1.
Figure 3:
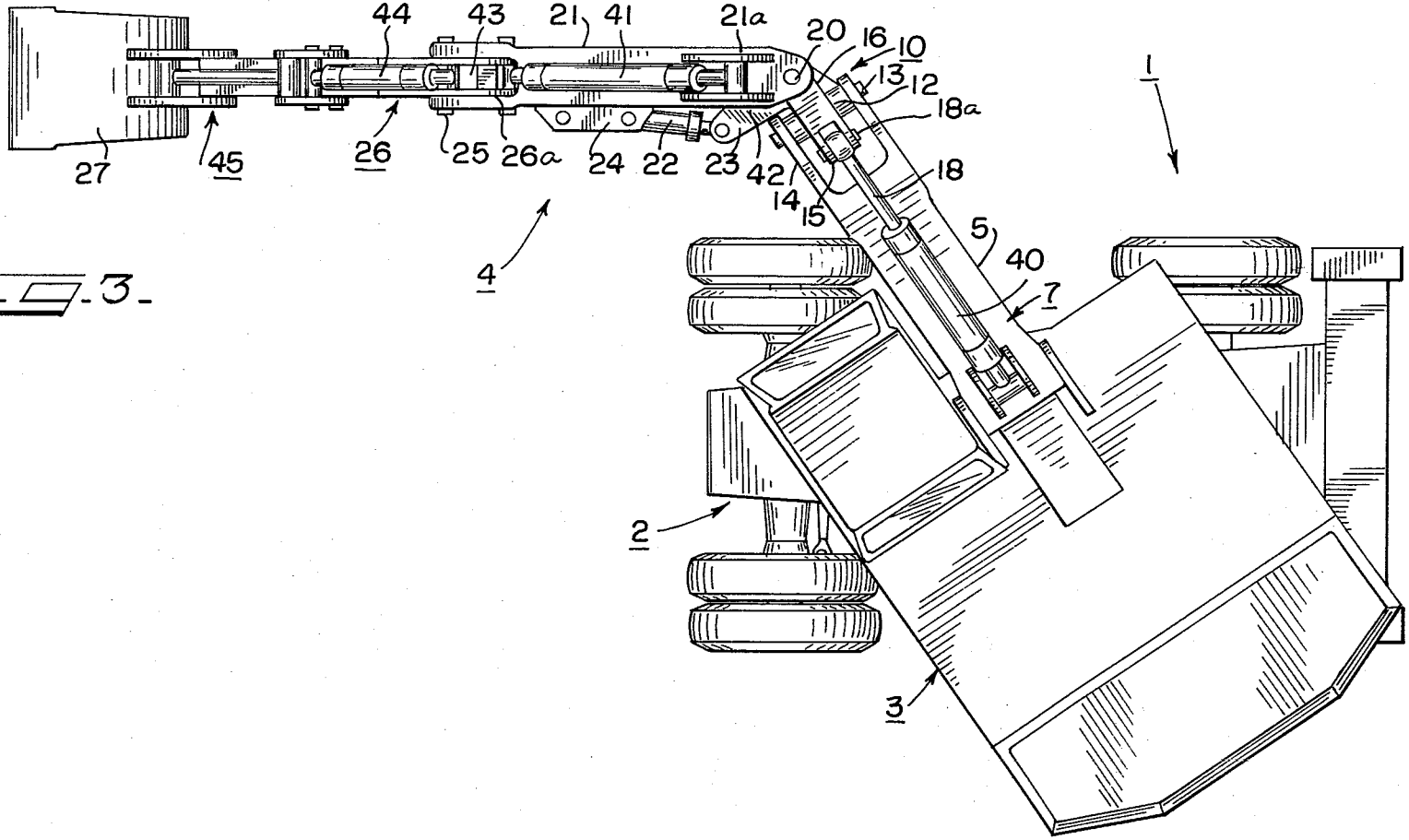
FIG. 3 is a plan view of the apparatus shown in FIG. 2.

The digging or excavating equipment 4 includes a lifting arm 5 which is pivotally connected at one end to the revolving platform 3 by a support pin 5*a* which lies in a plane parallel to the work plane (in FIG. 2 horizontal) and the base 2 of the hydraulic excavator 1. The movement of lifting arm 5 is effected and controlled by a maneuver actuator 6 which includes a cylinder 8 pivoted at the base on a pin 8*a*, carried by the revolving platform 3. A cylinder rod 7 is extended or retracted under the control of the displacement of a piston 9 housed within the cylinder 8 and is pivoted at its free end to the lifting arm 5 by means of a pin 7*a*. The piston 9 subdivides the internal cavity of the cylinder 8 into two separate chambers 30 and 31 of which chamber 31 is traversed by the cylinder rod 7. The free end of the lifting arm 5, generally indicated by the reference numeral 10, includes a first bifurcated part having the form of a fork 11 and a second part formed as a bell crank shaped structure 12 connected to the first part or fork 11 by means of a pivot pin 13 the longitudinal center axis of which extends parallel to the support pin 5*a*. The pivot pin 13 is carried by the two opposite arms 14 which form the terminal end of the first or forked part 11. The bell crank shaped structure 12 has one lever end bifurcated to form two flanking and parallel appendages 15 which are connected through a pivot pin 18*a* of a hydraulic actuator 17 for a purpose to be hereinafter described in detail.

The relative position between the bell crank shaped structure 12 and the forked part 11 of the lifting arm 5 is controlled by the supplementary hydraulic actuator 17 having a cylinder rod 18 pivotally connected at its free end to the bifurcated portion of bell crank lever 15 by means of the pin 18*a*. Displacement of the cylinder rod 18 is controlled by a piston 19 moving within a cylinder 40 of the hydraulic actuator 17. The actuator 17 is pivoted at its base to the lifting arm 5 by means of a pin 40*a*. The internal cavity of the cylinder 40 is divided into two separate chambers 32 and 33 of which chamber 33 is traversed by rod 18 by means of the piston 19.

The bell crank shaped structure 12, which forms the second part of the free end 10 of the lifting arm 5, carries a pivot pin 20 the longitudinal axis of which extends normal to the work plane of the base 2 of the hydraulic excavator and, therefore, the plane in which the platform 3 revolves. The pivot pin 20 forms a pivotal connection between the bell crank shaped structure 12 and a bifurcated portion 21*a* of a side positioning arm 21. The opposite end of the side positioning arm 21 carries a work pin 25, the longitudinal center axis of which lies in a plane parallel to the work plane of the hydraulic excavator. A work arm 26 is pivotally connected at one end 26*a* to the pivot pin 25 and carries on its opposite end 26*b* a digging bucket 27 which penetrates the soil to produce the desired excavation.

Movement of the side positioning arm 21 about the pivot pin 20 is controlled by a hydraulic actuator 22 which is pivotally connected at one end to a protrusion 23 from the bell crank shaped structure 12 and at the opposite end thereof to a protrusion 24 of the side positioning arm 21. Operation of the hydraulic actuator 22 effects movement of the side positioning arm 21 in a plane normal to the longitudinal center axis of the pivot pin 20 and parallel to the work plane of base 2. The movement of the work arm 26 is controlled by a hydraulic actuator 41 which is pivotally connected at one end to a protrusion 42 of the side positioning arm 21 and at the opposite end to a protrusion 43 of the work arm 26. Actuation of the hydraulic actuator 41 effects movement of the work arm 26 in a plane normal to the longitudinal axis of the work pin 25 and the work plane of the hydraulic excavator.

The movement of the digging bucket 27 is controlled by means of an articulated lever system 45 through a hydraulic actuator 44. Actuation of the hydraulic actuator 44 effects pivotal movement of the digging bucket 27 about its connection 26*b* to the work arm 26.

In order to maintain the side walls of an excavation formed by the digging bucket 27 perpendicular or normal to the work plane of the excavator base 2, the bell crank shaped structure 12 is pivoted in response to movement of the lifting arm 5. Controlled movement of the bell crank 12 with the lifting arm 5 causes the pivot pin 20 to be maintained in a position wherein its longitudinal center line is always normal to the excavator base 2. To effect such movement of the bell crank shaped structure 12 a supplementary actuator 17, directly controlled by movement of the actuator 6, is actuated in response to the movement of the lifting arm 5. Control of the supplementary actuator 17 in response to the maneuver actuator 6 is effected by connecting the supplementary actuator 17 in series to the maneuver actuator 6 in a single hydraulic control circuit. The circuit includes a reservoir 28 containing a hydraulic fluid that is fed into the circuit. A first conduit or feed line 29 is connected from the reservoir 28 to the chamber 30 of the maneuver actuator 6. An intermediate conduit or line 34 connects the chamber 31 of the actuator 6 with the chamber 32 of the actuator 17. A second feed line or conduit 35 connects the chamber 33 of the supplementary actuator 17 with the reservoir 28. A pump 36 is coupled into the first feed line 29 upstream from a commutator slide valve 37 which is movable into two different positions to reverse the function of the two feed lines 29 and 35.

In a second position of slide valve 37 the first feed line 35 functions as the circuit return. In such operation the actuator 6 produces the raising of lifting arm 5 and in a corresponding manner the supplementary actuator 17 effects rotation of the bell crank shaped structure 12 in an opposite direction to the movement of the lifting arm 5. In the second position of the commutator slide valve 37 the feed line 29 acts as a return line while the feed line 35 acts as the delivery line. In this mode of operation the arm 5 lowers and, in a corresponding manner, the bell crank shaped structure 12 rotates in an opposite direction. The rotation of the bell crank shaped structure 12 is thereby proportional to the displacement of the lifting arm 5 and always occurs in an opposite direction to that in which the lifting arm 5 rotates. With appropriate sizing of the two cylinders 8 and 40, associated respectively with the maneuver actuator 6 and the supplementary actuator 17, it is possible to effect rotation of the bell crank shaped structure 12 so as to retain the pivot pin 20 always substantially in an orientation wherein the longitudinal center axis thereof is maintained perpendicular to the work plane of the excavator 1 whatever position the lifting arm 5 may assume during its working movements. Maintaining the longitudinal center axis of the pivot pin 20 perpendicular to the work plane of the excavator permits the plane passing through the longitudinal center axis of the pin 20 and the plane of movement of the work arm 26 and the bucket 27 substantially perpendicular to the work plane. Maintaining the plane of movement of the work arm 26 and bucket 27 perpendicular to the work plane results in an excavation wherein the side walls are perpendicular to the work plane and the bottom of such excavation is parallel thereto. Such an objective can also be achieved by separate independent hydraulic controls of the actuators 6 and 17 in order to maintain the pivot rod 20 perpendicular to the working plane or mounting the fixed end of the hydraulic actuator cylinders to other reference points for achieving the same objectives.

While the invention has been described with reference to a preferred embodiment, it will be understood by those skilled in the art that various changes may be made and equivalements may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An excavator supported on a work plane for effecting excavations parallel to and laterally spaced from the longitudinal axis of the excavator comprising a lift arm supported at one end on an excavator base positioned parallel to a work plane for pivotal movement in a plane normal to the excavator work plane, said lift arm including a coupling portion supported at an opposite end for rotational movement within the plane of movement of said lift arm, material excavating means operatively connected to said coupling portion for movement in a path of movement determined by the rotational position of said coupling portion, and means for effecting rotational movement of said coupling portion in direct response to movement of said lift arm for maintaining the path of movement of said excavating means within a plane normal to the excavator work plane throughout varying pivotal positions of said lift arm.

2. The apparatus of claim 1 wherein said coupling portion comprises a bell crank having a pivot pin supported in one lever arm thereof for operative connection to said material excavating means and another lever arm thereof connected to said means for effecting rotational movement of said coupling portion.

3. The apparatus of claim 2 wherein said material excavating means includes a first arm pivotally connected at one end to said pivot pin for movement in a plane parallel to said excavator work plane.

4. The apparatus of claim 3 wherein said material excavating means further includes a second arm pivotally connected at one end to an opposite end of said first arm for movement in a plane normal to the longitudinal axis of the pivotal connection.

5. The apparatus of claim 1 wherein said means for effecting rotational movement of said coupling portion in direct response to movement of said lift arm comprises at least two hydraulic actuators connected in series in a hydraulic circuit such that movement of a cylinder rod of one hydraulic actuator effects proportional movement of a cylinder rod of the other hydraulic actuator in an opposite direction.

6. The apparatus of claim 5 wherein one of said cylinder rods of said hydraulic actuators is connected to said lift arm to effect movement thereof in a plane normal to the excavator work plane.

7. The apparatus of claim 6 wherein one of said cylinder rods of said hydraulic actuators is connected to said means for effecting rotational movement of said coupling portion in direct response to movement of the cylinder rod of the other of said hydraulic actuators.

8. The apparatus of claim 3 further including hydraulic actuator means coupled between said first arm and said coupling portion to move said first arm in a path of movement parallel to said excavator work plane.

9. The apparatus of claim 4 further including hydraulic actuator means coupled between said second arm and said first arm for movement of said second arm in a plane normal to the longitudinal axis of the pivotal connection.

* * * * *